US010099077B2

(12) United States Patent
Szocs

(10) Patent No.: US 10,099,077 B2
(45) Date of Patent: Oct. 16, 2018

(54) INSTALLED FIRE FIGHTING APPARATUS FOR FLAMMABLE OBJECTS

(71) Applicant: Istvan Szocs, Budapest (HU)

(72) Inventor: Istvan Szocs, Budapest (HU)

( * ) Notice: Subject to any disclaimer, the term of this patent is extended or adjusted under 35 U.S.C. 154(b) by 0 days.

(21) Appl. No.: 15/313,794

(22) PCT Filed: May 25, 2015

(86) PCT No.: PCT/HU2015/000051
§ 371 (c)(1),
(2) Date: Nov. 23, 2016

(87) PCT Pub. No.: WO2015/181575
PCT Pub. Date: Dec. 3, 2015

(65) Prior Publication Data

US 2017/0136274 A1 May 18, 2017

(30) Foreign Application Priority Data

May 27, 2014 (HU) ..... 1400270

(51) Int. Cl.
*A62C 3/06* (2006.01)
*A62C 35/13* (2006.01)
(Continued)

(52) U.S. Cl.
CPC ..... *A62C 3/065* (2013.01); *A62C 35/023* (2013.01); *A62C 35/13* (2013.01); *A62C 35/68* (2013.01); *A62C 99/0036* (2013.01)

(58) Field of Classification Search
CPC .. A62C 3/06; A62C 3/065; A62C 5/02; A62C 5/022; A62C 5/024; A62C 35/023;
(Continued)

(56) References Cited

U.S. PATENT DOCUMENTS 3,741,309 A * 6/1973 McCulloch ..... A62C 3/06 169/26
3,876,010 A * 4/1975 Blomquist ..... A62C 3/06 169/46

(Continued)

FOREIGN PATENT DOCUMENTS

EP 1075316 2/2001
WO 2003086546 10/2003

OTHER PUBLICATIONS

European Patent Office, International Search Report (Form PCT/ISA/210, 2 pgs.) and Written Opinion of the International Searching Authority (Form PCT/ISA/237, 5 pgs.), dated Sep. 24, 2015.

*Primary Examiner* — Darren W Gorman
(74) *Attorney, Agent, or Firm* — Wood Herron & Evans LLP

(57) ABSTRACT

The installed fire fighting apparatus has one or more forwarding pipelines to transfer a fire extinguishing substance composition to a place of use, and one or more spreading devices connected to the output end of the forwarding pipeline, serving for directed discharge of the fire extinguishing substance composition and designed to be fixed to a flammable object. The apparatus includes a storage pipeline to store the fire fighting substance composition, comprising a pipeline with a cross-section exceeding the cross-section of the forwarding pipeline and closed at its ends or closed into itself like a loop, where the storage pipeline is equipped with a feeder pipe end with a pressure-tight shut-off device, a valve on the feeder pipe end, as well as a device to measure pressure in the interior space of the storage pipeline and a safety fitting, preferably a safety valve. The storage pipeline has a forwarding branch-off, to which branch-off the forwarding pipeline is connected by its input end. The forwarding pipeline has a flow control valve inserted both beside the branch-off location and at a distance
(Continued)

Figure 1:
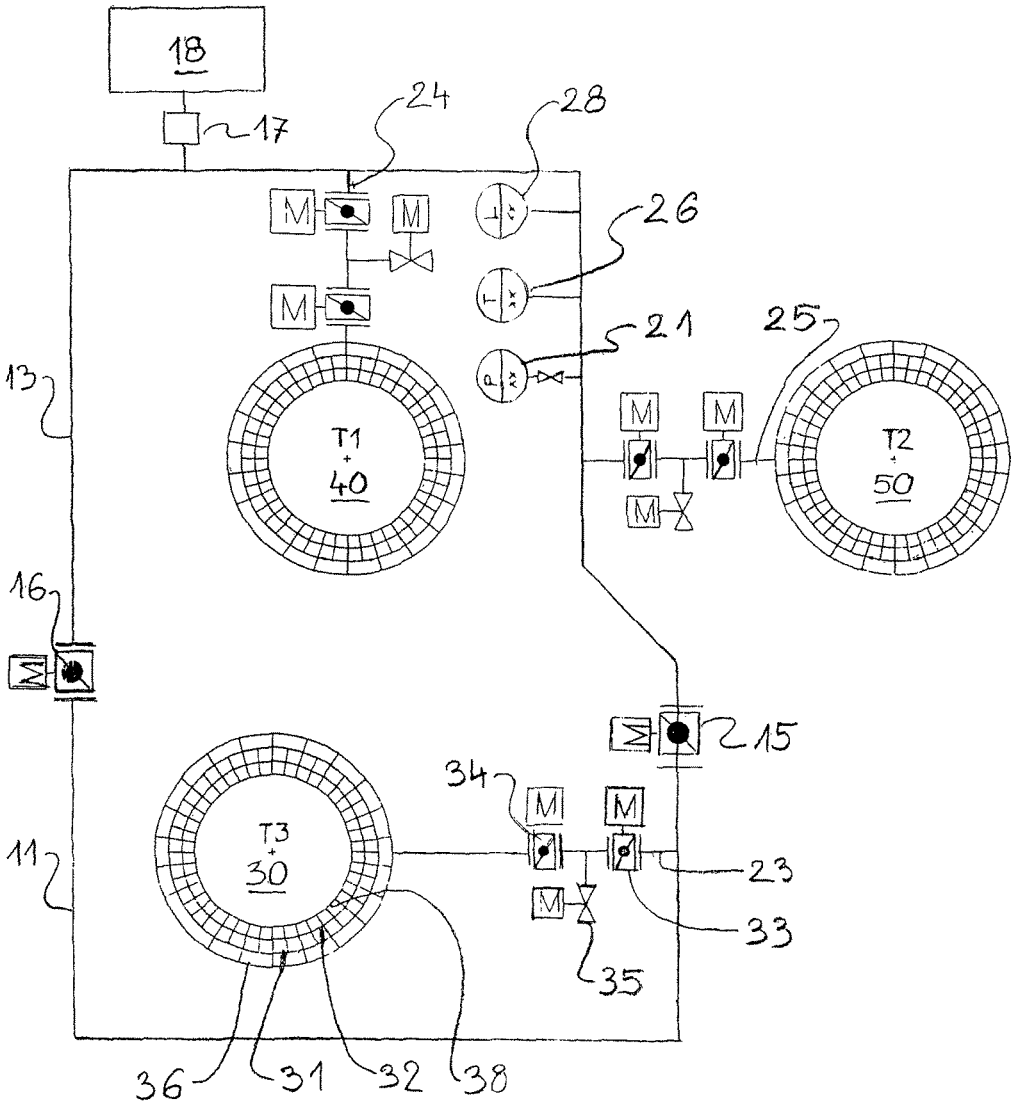

therefrom, and a pressure release branch-off is fitted between the two flow control valves, where such pressure release branch-off is equipped with a shut-off valve. There is a fire extinguishing substance composition filled in the storage pipeline, which is a mixture of a fire fighting substance and a pressurized gas. The apparatus is fitted with at least two individual fire sensors designed to be located at various places of the flammable object and capable to distinguish fires according to extinguishing output demand.

15 Claims, 2 Drawing Sheets

(51) Int. Cl.

| | |
|---|---|
| ***A62C 35/68*** | (2006.01) |
| ***A62C 37/36*** | (2006.01) |
| ***A62C 35/02*** | (2006.01) |
| *A62C 99/00* | (2010.01) |

(58) Field of Classification Search
CPC ..... A62C 35/13; A62C 35/68; A62C 37/10; A62C 37/36; A62C 37/44; A62C 99/0036
See application file for complete search history.

(56) References Cited

U.S. PATENT DOCUMENTS

| | | | | |
|---|---|---|---|---|
| 3,896,881 | A * | 7/1975 | De Boer | A62C 3/06 169/16 |
| 4,148,361 | A * | 4/1979 | Christensen | A62C 3/06 169/66 |
| 4,893,681 | A * | 1/1990 | Flandre | A62C 3/06 169/14 |
| 5,330,009 | A * | 7/1994 | Zhang | A62C 3/06 169/26 |
| 5,548,933 | A | 8/1996 | Sharma et al. | |
| 6,966,503 | B1 | 11/2005 | Chen | |
| 8,336,637 | B2 * | 12/2012 | Alsaffar | A62C 3/065 169/16 |
| 2007/0119605 | A1 * | 5/2007 | Williams | A62C 3/065 169/68 |

* cited by examiner

INSTALLED FIRE FIGHTING APPARATUS FOR FLAMMABLE OBJECTS

This application claims priority, under Section 371 and/or as a continuation under Section 120, to PCT Application No. PCT/HU2015/000051, filed on May 25, 2015, which claims priority to Hungarian Application No. P1400270, filed on May 27, 2014.

The invention relates to an installed fire fighting apparatus for flammable objects, to be applied most of all as a fire fighting apparatus for tanks to store flammable fluids, particularly tank farms.

There are known installed fire fighting apparatuses extinguishing by foam, applied for tanks to store flammable fluids, which comprise a tank, a pipeline connected to the tank through a valve, and a device to spread foam, fixed onto the end of the pipeline in a proper direction, where a fire fighting foam composition ready to use is stored in the tank under pressure, which consists of an aqueous solution of a fire extinguishing foaming agent with a gaseous medium, serving as a foaming and propellant gas, dissolved or dispersed in it.

At the time of use, the overpressure in the tank makes the fire fighting foam composition flow to the place of use (fire fighting), properly above the fluid surface to be extinguished by the valve being opened to a space of atmospheric pressure through the pipeline, where the foam composition is discharged from the device to spread foam at the end of the pipeline to the space of atmospheric pressure. The gaseous medium within the fire fighting foam composition expands as its pressure drops from overpressure to atmospheric pressure, thereby the bubbles of the foam composition are blown up to their size tallying with atmospheric pressure, cover the surface of the fluid to be extinguished, seal it off from oxygen and air, and thus suppress the fire. This fire fighting apparatus operates effectively and can be properly applied for flammable fluid storage tanks, but it is costly, which represents a disadvantage.

At the time of apparatus installation, it is mandatory to design the tank as a pressure vessel according to the regulations in effect in the country concerned, taking corrosion resistance into account as a primary consideration, then to obtain regulatory approval for the plans, to qualify the manufacturing plant and to subject the tank to authority pressure testing.

The finished apparatus needs maintenance; in this respect, the most difficult thing is tank maintenance as it is mandatory to be performed at specific intervals as prescribed by requirements in effect in the country concerned.

As regards apparatus maintenance, it is relatively easy to inspect pipelines mainly made of metal and generally laid at ground surface; at the same time, tank maintenance is frequently cumbersome and costly: for instance, in case of tanks difficult to access or installed at remote locations, tank check is complicated and the tools required therefor are difficult to provide.

Further costs are incurred when the fire fighting foam composition stored at overpressure must also be removed for pressure tests and to be reloaded after such pressure tests at the quality level required after a quality check.

A further difficulty of such a fire fighting apparatus is that the pressurized fire fighting foam composition must be kept at temperatures within a specific temperature range in order to retain its quality. This implies that heat insulation cover, heatable and/or coolable cover as the case may be, must be provided for the fire fighting foam composition storage tank, or the tank must be installed in an enclosed space of nearly constant temperature, within a building as the case may be.

Another disadvantage is that in general, a fire fighting apparatus with a capacity dimensioned in line with the size of each tank is installed separately to each flammable fluid storage tank, or perhaps a common fire fighting apparatus is installed for up to two flammable fluid storage tanks at a safe distance from each other. In case of a tank farm, this requires a relatively large number of fire fighting apparatuses independent of each other, which entails high costs. At the same time, it is a drawback that each apparatus operates separately from each other, so if required, in the event that one of the fire fighting apparatuses breaks down or gets empty, the apparatus dropped out cannot be supplemented by another apparatus.

Another disadvantage of such equipment is that during equipment operation, the full quantity of foam composition inside is spread fairly quickly, in up to 2-3 minutes, to the surface to be extinguished, regardless of the quantity of foam composition that would be sufficient for safely extinguishing the fire broken out. This requires in each case the total refill of the fire fighting equipment, which is costly, on the one hand, and causes a forced interruption in storage tank operation.

Therefore the task has been set to develop a fire fighting apparatus which requires less maintenance so its operation is less costly in addition to sustained reliability.

A further task has been to develop a fire fighting apparatus that can be applied as a common centrally installed fire fighting apparatus for several inflammable objects, principally a number of flammable fluid storage tanks within a tank farm, without jeopardizing safe plant operation.

Another task has been to develop a fire fighting apparatus capable to distinguish between fires of sealing gaps and of entire surfaces within tanks with floating roofs, in order to be able to give a proportionate fire fighting response to these two cases of fire different in terms of extinguishing power demand, thereby to be able to reduce the quantity of fire fighting substance to be stored.

Another task in connection therewith has been to develop a fire fighting apparatus to ensure that the fire fighting substance is admitted only in quantities sufficient for extinguishment.

This invention is based on the recognition that on the one hand, the tank of the fire fighting apparatus, as the most or most highly maintenance intensive part of the apparatus, should be substituted by a device that is, in addition to being suitable for storing an appropriate quantity of extinguishing material, requires much less maintenance or none at all without decreasing the operational reliability of the apparatus, on the one hand, and on the other hand, a fire sensor solution should be applied in the apparatus that can distinguish between a fire at the tank sealing gap and the entire surface in order to reduce the quantity of fire fighting substance used. It is further recognized that such sensors should be applied in the apparatus which provide feedback on the fire being extinguished and thus make it possible to stop any further feed of the extinguishing agent in order to be able to further reduce the quantity of the extinguishing agent used.

So the solution of the problem according to the invention is an installed fire fighting apparatus for flammable objects, particularly for flammable fluid storage tanks, which has one or more forwarding pipelines to transfer a fire extinguishing substance composition to a place of use, and one or more spreading devices connected to the output end of the forwarding pipeline serving for directed discharge the fire extinguishing substance composition and designed to be fixed to a flammable object.

The essence of the apparatus that it includes a storage pipeline to store a fire fighting substance composition, comprising a pipeline with a cross-section exceeding the cross-section of the forwarding pipeline and closed at its ends or closed into itself like a loop, where the storage pipeline is equipped with a feeder pipe end with a pressure-tight shut-off device, a valve on the feeder pipe end, as well as a device to measure pressure in the interior space of the storage pipeline and a safety fitting, preferably a safety valve, furthermore, the storage pipeline has a forwarding branch-off, to which branch-off the forwarding pipeline is connected by its input end, and the forwarding pipeline has a flow control valve inserted both beside the branch-off location and at a distance therefrom, and a pressure release branch-off is fitted between the two flow control valves, where such pressure release branch-off is equipped with a shut-off valve, and the fire extinguishing substance composition filled in the storage pipeline is a mixture of a fire fighting substance and a pressurized gas, furthermore, the apparatus is fitted with at least two individual fire sensors designed to be located at various places of the flammable object and capable to distinguish fires according to extinguishing output demand.

A preferred embodiment of the apparatus is equipped with a high-pressure gas storage tank which is connected to the storage pipeline directly or through a pressure stabilizer unit.

A preferred embodiment of the apparatus is equipped with at least one sensor to signal fire extinguishment.

Particularly in the case of tank farms, a preferred embodiment of the apparatus includes a storage pipeline divided into storage conduit sections along its length. At one of the solutions, adjacent storage conduit sections are connected to each other through connecting valves; at another solution, storage conduit sections are connected to each other by connecting pipe pieces, where the connecting pipe piece has a valve at each of its two ends and a pressure release branch-off with a pressure-tight shut-off device between such valves.

In case of a divided storage pipeline design, it is a preferred structure, where the two adjacent storage conduit sections, connected to each other through connecting valve, have separate feeder pipe ends equipped with a valve.

The storage pipeline is made of a corrosion-resistant material, preferably fiber-reinforced plastic or stainless steel, or the storage pipeline has a corrosion protection coating.

In a preferred embodiment, the storage pipeline is arranged in a horizontal or nearly horizontal position, and the forwarding pipeline branches off from the bottom side of the storage pipeline.

In an other preferred embodiment of the apparatus, the storage pipeline is partly sunk underground or laid completely under ground level.

In a preferred embodiment of the apparatus, to be applied particularly for flammable fluid storage tanks, the fire fighting substance component of the fire extinguishing substance composition is a fluid extinguishing agent, preferably a solution of a foaming agent and water, or any other fluid suitable for fire fighting or a mixture thereof with water, or an extinguishing gas liquefied under pressure.

A highly preferred embodiment of the apparatus is where the inner space of the storage pipeline or any storage conduit section is fitted with a device to measure temperature and/or fluid level.

The gas component of the fire fighting substance composition applied for a foam extinguisher apparatus is a foaming gas and a propellant gas, which are the same gas or a gas mixture.

The gas component of the fire fighting substance composition applied for an other foam extinguisher apparatus is a foaming gas or gas mixture and a propellant gas which propellant gas is a different gas or a gas mixture containing different gas.

A highly preferred embodiment of the apparatus is where the fire extinguishing component of the fire fighting substance composition is an aerosol of a fire extinguishing solid.

A flammable object can be a flammable fluid storage tank or a tank farm with such tanks installed, an object using flammable substances, for instance a semiconductor manufacturing plant, an airplane hangar, or even an office building requiring increased security.

The spreading device to discharge the fire extinguishing substance composition onto the surface of the flammable fluid is an expander nozzle of appropriate structure; in case of a foam-type fire extinguishing substance composition, it can be a traditional nozzle or a so-called gap jet (continuous linear nozzle), with or without a pressure equalizing chamber, a pressure relief gage ring, or a pressure relief tank.

Commercially available fire fighting substances, for example foaming substances for fire fighting purposes, can be applied as a fire fighting substance of the fire extinguishing substance composition.

A certain kind of gas or a mixture of several kinds of gases can be applied as a gas component of the fire extinguishing composition, applying, as the case may be, a separate gas or gas mixture for fire fighting foam generation and a different gas or gas mixture for discharging the foam, properly conforming to the fire fighting substance. Such gas is preferably nitrogen, for instance, etc. In a preferred embodiment of the apparatus, the foaming gas and the propellant gas constitute a gas mixture, including components like halogenized hydrocarbon, carbon dioxide, etc.

The fire sensors applied in the apparatus according to the invention can be mechanical, pneumatic, hydraulic, electric or electronic sensors selected according to the location of use; the sensor to signal fire extinguishment is preferably an optical sensor such as a video camera, or a mechanical sensor, for example a float switch or a humidity sensor. The signals provided by such sensors are received and processed by the control unit of the apparatus, and the flow control valves are controlled according to such information content.

Pneumatic sensors can preferably be of a plastic pipe or sprinkler head design, filled by pressurized gas, principally by air, and generally equipped with a pressure switch.

Figure 2:
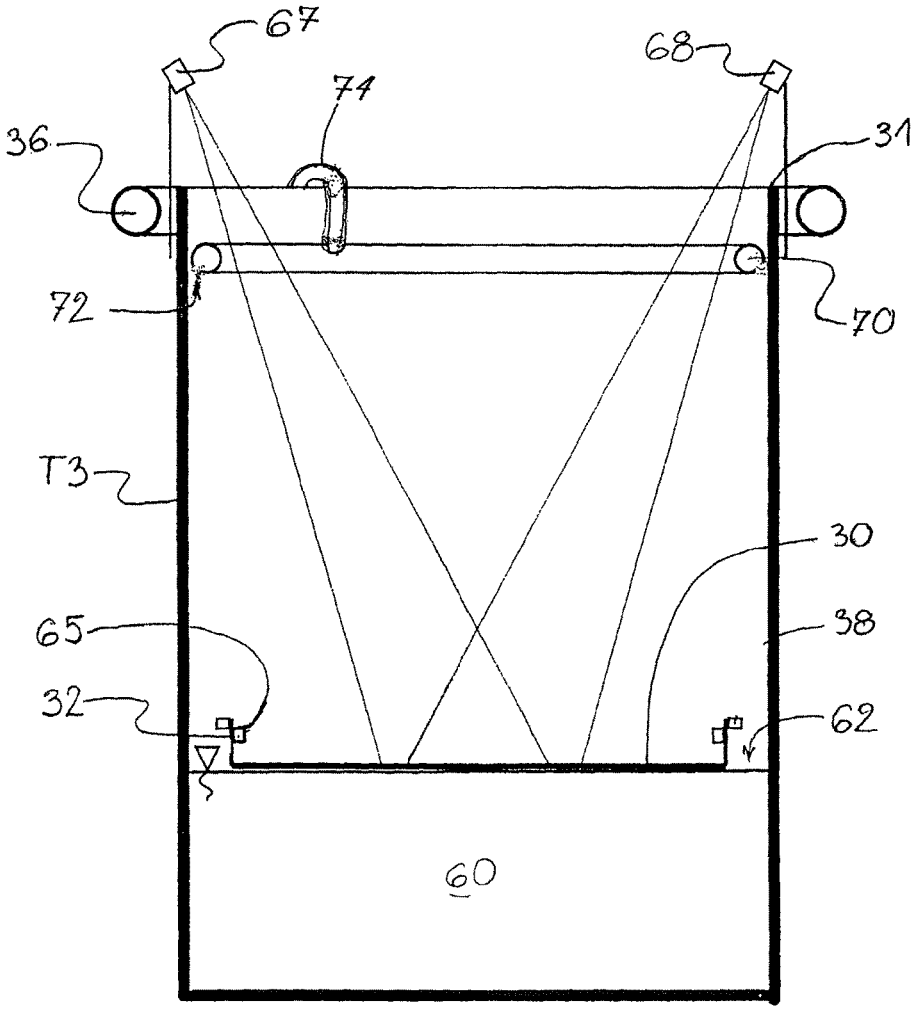

The essence of the installed fire fighting apparatus according to the invention is to be presented in more detail by way of its preferred embodiment, with reference to the schematic drawing enclosed, where FIG. 1 shows the theoretical design of an installed foam fire extinguisher apparatus located in a tank farm, and FIG. 2 shows the schematic cross-section of one of the tanks shown in FIG. 1.

A tank farm shown in FIG. 1 comprises three fluid hydrocarbon tanks T1, T2 and T3, which are flammable objects. The tanks T1, T2 and T3 are floating roof tanks; the figure shows floating roofs 40, 50, and 30 of each tank, respectively; as well as for the tank T3, an upper mantle rim 31 of the tank mantle, a foam barrier 32 and a sensor 38 on the floating roof 30 are indicated, all of which can be clearly observed and detailed in FIG. 2 showing the cross-section of the tank T3.

The installed fire fighting apparatus according to the embodiment in the example is a foam extinguisher apparatus, whose fire fighting medium is a fire extinguishing substance composition, which composition is a mixture of a fire fighting substance and a pressurized gas. The fire extinguishing substance is an aqueous solution of a foaming agent, in which the gas component of the fire extinguishing substance composition, which is a certain kind of gas or a gas mixture of several gases, is absorbed under pressure as a foaming gas and a propellant gas, and the finished composition as a compressed fire extinguishing foam is stored in a storage pipeline—as its location of storage—to be described later on, by maintaining pressure until use.

The installed fire fighting equipment has forwarding pipelines 23, 24 and 25, designed for conducting the fire extinguishing substance composition to its location of use, in this embodiment to each of the tanks T1, T2, and T3. The output end of each of the forwarding pipelines 23, 24 and 25 is fitted with a fire extinguishing substance composition spreading device, serving for directed discharge the fire extinguishing substance composition and designed to be fixed onto the flammable object, in this embodiment to the upper rim of the mantle of each of the tanks T1, T2 and T3. In this embodiment, such fire extinguishing substance composition spreading device is a foam spreading appliance, consisting of a foam gage ring 36 fixed on the outside at the upper mantle rim 31 of the tank T3, and a linear nozzle 70, indicated in FIG. 2, connected thereto, fixed on the inside of the mantle, also to be clearly observed in FIG. 2 showing the cross-section of the tank T3.

Furthermore, the apparatus includes a storage pipeline to store a fire fighting substance composition as a source of fire extinguishing substance composition, as a source of fire extinguishing foam in this embodiment, comprising a pipeline with a cross-section exceeding the cross-section of the forwarding pipelines 23, 24 and 25 and closed into itself like a loop. The storage pipeline is divided into two storage conduit sections 11 and 13, connected to each other through connecting valves 15 and 16; in this embodiment, the valves 15 and 16 are motor driven.

One of the conduit sections of the storage pipeline is equipped with a feeder pipe end with a pressure-tight shut-off device and a valve on the pipe end, through which the pipeline is filled up with compressed fire extinguishing foam. Furthermore, one of the conduit sections of the storage pipeline is equipped with a device to measure pressure in its interior space and a safety fitting, primarily a safety valve, as well as with a device to measure temperature and fluid level in its interior space, out of which a pressure gauge 21, a thermometer 26 and a fluid level gauge 28 are shown in the figure, and which are to check the condition of the fire fighting foam stored under pressure.

The storage pipeline has a volume corresponding to the quantities of fire extinguishing foam intended to be generated from corresponding quantities of foaming substance and water, and to the quantities of the pressurized foaming and propellant gas or gas mixture to be dissolved or emulgeated therein, and is pressure and corrosion resistant in order to be protected from the pH effect of the foaming agent and the propellant gas. The storage pipeline is made of a corrosion-resistant material of appropriate strength, preferably stainless steel or possibly fiber-reinforced plastic. The storage pipeline is arranged in a horizontal position and laid under ground level for protection against unwanted impacts such as temperature fluctuations, damage, etc.

Furthermore, the apparatus is equipped with a high-pressure gas storage tank 18 which is connected to the storage pipeline through a pressure stabilizer unit 17, ensuring that operating pressure is maintained in the storage pipeline as necessary in case of an unwanted pressure drop, and assisting the fire extinguishing foam in reaching its place of use during the operation of the apparatus.

In the upper part of the interior of the storage pipeline, there is a gas space amounting to at least 5-10% of its volume, being filled with only a pressurized gas-phase substance in the proper horizontal position of the storage pipeline.

The storage pipeline is equipped with forwarding branch-offs opening from its bottom side, to each of which branch-offs a forwarding pipeline 23, 24 and 25, respectively, are connected by their input end. As also indicated by a sign of reference at the pipeline 23 leading to the tank T3, each of the forwarding pipelines 23, 24 and 25 have a flow control valve 33 and 34 inserted beside the branch-off location and at a distance therefrom, respectively; and a pressure release branch-off is fitted between the two flow control valves 33 and 34, where such pressure release branch-off is equipped with a shut-off valve 35. This ensures separability of a part of the fire fighting apparatus connected to any of the tanks without affecting operability. In this embodiment, the valves 33, 34 and 35 are motor driven. The forwarding pipelines 23, 24 and 25 are made of a material of adequate strength, with a cross-section selected according to the quantity of the fire extinguishing foam to be forwarded.

FIG. 2 shows a cross-section of the tank T3. The tank T3 comprises a flammable fluid 60, on top of which a floating roof 30 is floating. The floating roof 30 is fitted with a foam barrier 32 standing upright, and there is a sealing gap 62 between the floating roof 30 and the wall of the tank T3. Along the external side of the foam barrier 32, there is a fire sensor 38 located in a ring-shaped arrangement, giving signals in case of a fire breaking out in the sealing gap 62. A sensor 65 located on the inner side of the foam barrier 32 is intended to signal foam overflow, meaning that the foam composition flowing out of the fire fighting apparatus has filled the gap 62 to a height where it overflows the foam barrier 32, which also means that fire has been extinguished successfully in the gap 62 and no more fire extinguishing foam composition quantities are required.

Video cameras 67 and 68 are fixed onto poles placed at the upper rim 31 of the tank T3, directed to the central area of the floating roof 30, thereby serving as fire sensors to give signals of fires of the entire surface.

At the upper rim 31 of the tank T3, the foam gage ring 36 fixed on the outside of the tank mantle, the linear nozzle 70 fixed to its inside, and a connecting pipe 74 linking the foam gage ring 36 and the linear nozzle 70 can be clearly observed. A gap 72 of the linear nozzle 70 is directed to the inside of the mantle of the tank T3, in order for the fire extinguishing foam composition to cool the mantle by flowing down on it during operation, in addition to flowing onto the fluid surface when reaching it and closing up thereon, sealing it of from air and oxygen and thus extinguishing the fire.

At rest, the storage pipeline of the apparatus stores the fire extinguishing foam composition under pressure, ready to use. In case of a fire at any of the tanks, the compressed fire extinguishing foam composition is discharged by overpressure through the foam spreading device of the tank concerned into the tank on fire—as an open air space—upon opening the two flow control valves in the forwarding pipeline leading to the tank concerned. The pressurized foaming and propellant gas dissolved or dispersed in the fire extinguishing foam composition expands at atmospheric pressure, the foam quantity increases and thus extinguishment is performed without any additional energy input.

The main advantage of the installed fire fighting apparatus according to the invention is that it has no fire extinguishing substance composition storage tank, thereby all design, plan approval, manufacturing plant qualification, manufacturing, maintenance, and periodic inspection works related especially to the tank as a pressurized vessel are eliminated. The fire extinguishing substance composition is stored under pressure in the storage pipeline forming a part of the pipeline network of the apparatus and having a cross-section larger than other pipelines. The storage pipeline is dimensioned to a pressure range generally customary for industrial pipelines; prices of fittings dimensioned for such pressure are small, requiring low investment expenses. Maintenance and periodic checks and inspections of the storage pipeline can be performed together with the other pipelines of the apparatus, requiring much less work; besides, it is simpler than to perform the same thing in respect of a tank.

A further advantage of the apparatus is that in the course of its operation, the fire extinguishing substance composition can be forwarded through overpressure, only by opening the two flow control valves between the storage pipeline and the connecting forwarding pipeline specified for extinguishing the fire, to the place of use without any additional energy input at a speed determined by the rate of overpressure in the forwarding pipeline, and the friction between the fire extinguishing substance composition and the conduit walls of the distribution pipeline network, and at the place of use it can be properly used for extinguishing the fire by spreading it through the spreading device.

Another advantage of the apparatus according to the invention is that the fire extinguishing substance composition spread out, in particular, the fire fighting foam composition spread by the linear nozzle also binds a considerable part of the smoke generated in the course of burning, which reduces environment pollution by the fire.

Yet another advantage of the apparatus according to the invention is that two separate, stand-alone fire sensor groups independent of each other are applied for the differentiated detection of fires of various sizes and types (fire at sealing gap versus on the entire surface), which is advantageous because this way progressive extinguishment parameters adjusted to the size of a fire can be pre-programmed and an adequate fire fighting response can be provided. Thereby both the time of extinguishment and the quantity of the fire extinguishing substance can be reduced.

Still another advantage of the apparatus according to the invention is that it is equipped with sensors to provide feedback on fire extinguishment or cessation, which can be made to influence fire fighting control in a way that the flow of the fire extinguishing substance composition is stopped after the fire is extinguished successfully, thereby only using such a quantity of the fire extinguishing substance composition that is required for extinguishing the fire, which brings about economic advantages.

On the whole, the advantages listed make it possible to specify the required fire extinguishing substance composition storage capacity more accurately, which entails economic advantages and increases the safety level of the fire fighting apparatus because a given quantity of fire extinguishing substance composition can be used for extinguishing more fires or fires of larger surface area than by using state-of-the-art equipment.

The invention claimed is:

1. An installed fire fighting apparatus for flammable objects, comprising:

at least one forwarding pipeline having an input end and an output end to transfer a fire extinguishing substance composition to a place of use, the at least one forwarding pipeline having a first cross-section;

at least one spreading device connected to the output end of the at least one forwarding pipeline for directional discharge of the fire extinguishing substance composition and configured to be fixed onto a flammable object; and a storage pipeline for storing the fire extinguishing substance composition, the storage pipeline comprising a pipeline with a second cross-section exceeding the first cross-section of the at least one forwarding pipeline and closed at its ends or closed into itself to form a loop, wherein the input end of the at least one forwarding pipeline is connected to the storage pipeline at a branch-off location, the at least one forwarding pipeline has two flow control valves inserted at the branch-off location and at a distance therefrom, respectively, and a pressure release branch-off fitted between the two flow control valves, wherein the pressure release branch-off includes a pressure release shut-off valve, and the fire extinguishing substance composition filled in the storage pipeline is a mixture of a fire fighting substance and a pressurized gas, and the apparatus further comprises at least two individual fire sensors configured to be positioned at various locations of the flammable object and configured to distinguish fires according to extinguishing output demand.

2. The apparatus according to claim 1, further comprising:

a high-pressure gas storage tank which is connected to the storage pipeline directly or through a pressure stabilizer unit.

3. The apparatus according to claim 1, further comprising:

at least one sensor to signal fire extinguishment.

4. The apparatus according to claim 1, wherein the storage pipeline is divided into first and second storage conduit sections.

5. The apparatus according to claim 4, wherein the first and second storage conduit sections are connected to each other with a connecting valve.

6. The apparatus according to claim 4, wherein the first and second storage conduit sections are connected to each other with a connection pipe piece, wherein the connection pipe piece includes two ends and a connection valve at each of the two ends and a connection pressure release branch-off with a pressure-tight connection shut-off device between the connection valves.

7. The apparatus according to claim 1, wherein the storage pipeline is constructed of a corrosion-resistant material including a fiber-reinforced plastic or stainless steel, or the storage pipeline has a corrosion protection coating.

8. The apparatus according to claim 1, wherein the at least one spreading device to discharge the fire extinguishing substance composition is a nozzle and/or a linear nozzle.

9. The apparatus according to claim 1, wherein a fire fighting substance component of the fire extinguishing substance composition is a fluid extinguishing agent including a solution of a foaming agent and water, or any other fluid suitable for fire fighting or a mixture thereof with water, or an extinguishing gas liquefied under pressure.

10. The apparatus according to claim 9, wherein the storage pipeline is arranged in a horizontal or nearly horizontal position, and the at least one forwarding pipeline branches off from a bottom side of the storage pipeline.

11. The apparatus according to claim 1, wherein the storage pipeline is partly sunk underground or laid completely under ground level.

12. The apparatus according to claim 9, wherein the storage pipeline is divided into first and second storage conduit sections, and the inner space of the storage pipeline or any of the first and second storage conduit sections is fitted with a device to measure temperature and/or fluid level.

13. The apparatus according to claim 9, wherein the gas component of the fire extinguishing substance composition is a foaming gas and a propellant gas, which are the same gas or a gas mixture.

14. The apparatus according to claim 9, wherein the gas component of the fire extinguishing substance composition is a foaming gas or a gas mixture and a propellant gas which propellant gas is a different gas or a gas mixture containing a different gas.

15. The apparatus according to claim 1, wherein a fire fighting component of the fire extinguishing substance composition is an aerosol of a fire extinguishing solid.

* * * * *